United States Patent [19]

Caudill

[11] Patent Number: 4,934,038

[45] Date of Patent: Jun. 19, 1990

[54] METHOD AND APPARATUS FOR TUBE EXPANSION

[75] Inventor: Maurice L. Caudill, Peoria, Ill.

[73] Assignee: Caterpillar Inc., Peoria, Ill.

[21] Appl. No.: 407,974

[22] Filed: Sep. 15, 1989

[51] Int. Cl.[5] ..... B21D 39/04

[52] U.S. Cl. ..... 29/523; 72/393; 72/479

[58] Field of Search ..... 72/393, 479; 29/507, 29/523

[56] References Cited

U.S. PATENT DOCUMENTS

| | | | |
|---|---|---|---|
| 2,357,123 | 8/1944 | Maxwell | 153/80.5 |
| 2,508,377 | 5/1950 | Doerr | 153/1 |
| 2,974,712 | 3/1961 | Frye | 153/80.5 |
| 3,345,730 | 10/1967 | Laverty | 29/243.52 |
| 3,358,492 | 12/1967 | Richter | 72/393 |
| 3,829,948 | 8/1974 | Miller et al. | 29/202 |
| 3,892,121 | 7/1975 | Champoux et al. | 72/393 |
| 4,212,186 | 7/1980 | Blattler | 72/393 |
| 4,262,518 | 4/1981 | Creger et al. | 72/393 |
| 4,597,282 | 7/1986 | Hogenhout | 72/370 |

FOREIGN PATENT DOCUMENTS

| | | |
|---|---|---|
| 938663 | 2/1956 | Fed. Rep. of Germany . |
| 186959 | 11/1966 | U.S.S.R. . |
| 192159 | 4/1967 | U.S.S.R. . |

*Primary Examiner*—Lowell A. Larson

*Attorney, Agent, or Firm*—Sterling Richard Booth, Jr.

[57] ABSTRACT

A method of joining a tube to a flange or wall member includes the steps of moving a plurality of circumferentially spaced workpiece contact surfaces into controlled pressure contact with the inner surface of a tube and maintaining a force against the inner tube surface sufficient to form an outer surface of the tube to a predetermined shape with respect to an opening surrounding the tube. The apparatus for expanding the tube has a plurality of radially movable segments, each of which have a pair of circumferentially offset and longitudinally spaced workpiece contact surfaces disposed thereon. The method and apparatus advantageously expands a tube by an amount sufficient to form a secure mechanical joint with a flange or wall member irrespective of nominal variations in the tube diameter and wall thickness. Furthermore, the method and apparatus form a uniformly smooth finish on the internal surface of the tube thereby eliminating the need for post-forming treatments to remove undesirable surface particles.

7 Claims, 3 Drawing Sheets

METHOD AND APPARATUS FOR TUBE EXPANSION

TECHNICAL FIELD

This invention relates generally to a metal deforming process and apparatus and more particularly to a metal deforming process for tube reshaping using an internal tool.

BACKGROUND ART

Forming a mechanical joint between the outer surface of a tube and a bore of a flange or wall member by expanding the tube is well known; however, even the most widely used and commercially successful tube expansion processes have limitations. First, many processes cannot produce a smooth, uniform internal tube wall surface. As a result of repeated cold working, roller-type expansion tools often cause spalling and flaking of the inner surface of the tube. Non-rotating forming tools which are expandable and mount on a mandrel have separate forming segments which typically leave inwardly projecting ridges or fins on the internal tube surface. Post-forming treatments remove these weakly attached fragments (i.e., flakes, rims, ridges, etc.) and clean internal surfaces of any material which could damage the system into which the assembly is subsequently installed.

U.S. Pat. No. 2,357,123 issued to Carl A. Maxwell offers approaches to forming a uniformly smooth finish on the internal surface of the tube. Maxwell first proposes to expand the internal tube surface with a split ball expander head comprising a plurality of radially displaceable segments with joints between adjacent segments formed at an angle skewed with respect to the direction of movement of the tool during forming. Tools having such oblique joints or openings between forming segments tend to peel thin strips of material from the tube because they dig into the tube surface during the expansion operation. Maxwell describes a second tool having a pair of longitudinally spaced, expandable, split rings. The design precludes constructing the split rings of hardened tool steel or similar relatively hard, inflexible material because the ring workpiece contact surfaces must flex during expansion. The need to form the split rings from a soft, flexible material limits the wear life of the forming elements and restricts the force which can be transmitted to the tube surfaces during the expansion operation. In addition, it is necessary to prevent rotation of the split rings because, if left free to rotate, they can align their respective openings during the forming operation.

Conventional expansion tools and processes do not uniformly expand tubes from one assembly to the next. Nominal variations in tube diameter and wall thickness dimensions preclude consistent tube deformation by tools which have a predetermined size or mechanical limit to the tool's expanded dimension. Consequently, mechanical joints between tubes and bores formed by expansion of the tube into the bore are often weak due to insufficient expansion, or they are prone to failure as a result of overstressing the tube or wall structures. Maxwell addresses this problem by measuring the pressure required to draw the forming tool through the tube. If this pressure is found to be below a predetermined value, Maxwell adjusts the mechanical stops on the forming tool and repeats the forming process. Not only is this approach inefficient, it also requires double working of the tube wall which can form surface defects and undesirable residual stresses.

U.S. Pat. No. 4,262,518 issued to Todd D. Creger et al. offers another approach to creating a smooth inner tube wall surface; however, Creger et al. retains the disadvantages associated with tools which expand to a predetermined size. Creger's tool includes a plurality of forming pieces circumferentially distributed around and loosely connected to a conical mandrel which has a firm support or stop at its larger end. As the mandrel is drawn through a tube to be expanded, friction drives the forming pieces toward the stop on the mandrel. When the forming pieces abut against the stop, the gaps between them are very small and skewed with respect to the longitudinal axis of the tube, thus the forming surface leaves few distortions on the inner tube wall. Since Creger's tool must expand to a predetermined size, it cannot provide the force necessary to over-expand tube to meet nominal variations in tube diameter and thickness or the size of the bore into which the tube is to expand. In an effort to properly handle joints which require under-expansion, Creger's device limits the hydraulic force applied to draw the expander through the tube. Reducing the hydraulic force prevents the forming pieces from abutting the mandrel stop and closing the gaps between the forming surfaces. This lack of closure leaves a rough surface on the inside surface of the tube.

U.S. Pat. No. 4,597,282 issued to Franciscus Hogenhout offers a different approach to creating a smooth surface on the inner surface of a cold-worked hole; however, Hogenhout retains the disadvantages associated with tools which expand to a predetermined size. Hogenhout has a tool for cold working a hole which includes a plurality of workpiece contacting surfaces circumferentially distributed around a solid mandrel. With the mandrel removed, the tool may be collapsed and inserted into a hole to be worked. The mandrel is inserted into the tool during the cold working process to expand the segments radially outward to a predetermined size. The segments have a first surface and a second surface which is circumferentially offset from the first surface. Gaps between the first workpiece surfaces create radially inwardly projecting fins in the hole which the second workpiece surfaces flatten. The tool provides for a smooth inner wall surface; however, the tool is severely limited in that it must expand to a predetermined size resulting in the same limitations as those set forth in the description of Creger's device above. In addition, the large gaps which must exist between the workpieces to permit the tool to collapse can adversely affect the (circular) cross-sectional shape of the tube once expanded.

The present invention is directed to overcoming one or more of the problems set forth above.

DISCLOSURE OF THE INVENTION

In accordance with one aspect of the present invention, a method of joining a tube to an opening in a wall member or flange includes positioning an end of the tube into one end of the opening extending through the wall member or flange and inserting an expandable punch through the opposite end of the wall member opening into the tube end. The expandable punch has a plurality of circumferentially spaced workpiece contacting surfaces which are moved radially outwardly into contact with the inner surface of the tube with a controlled force sufficient to form an outer surface of the tube to a predetermined shape with respect to a surface defining the opening in the wall member or flange. The controlled force contact of the workpiece contacting surfaces is maintained on the inner surface of the tube as the punch is moved longitudinally toward the opposite end of the wall member.

In another aspect of the present invention, an apparatus for expanding a tube for joining with a wall member includes a punch having a plurality of circumferentially-spaced, radially-movable segments. Each of the segments have a first and a second workpiece contacting surface disposed on a radially outer portion thereof, with the second workpiece contacting surface being circumferentially offset and longitudinally spaced with respect to the first surface. The apparatus also includes a device for moving the segments radially outwardly and a device for moving the punch along its longitudinal axis.

Other features of the method of joining a tube to a wall member include initially contacting the inner surface and simultaneously forming the outer surface of the tube to the predetermined shape and a plurality of radially inwardly extending ridges on the inner surface of the tube between adjacently spaced workpiece contact surfaces. The ridges are subsequently flattened by contacting the inner surface of the tube with a second plurality of workpiece contact surfaces on the punch.

Other features of the apparatus for expanding a tube for joining with a wall member include a mandrel coaxially disposed with respect to the longitudinal axis of the punch. The mandrel has a frustoconical surface portion at a distal end and a threaded portion at a proximal end. The frustoconical surface portion is positioned radially inwardly of the circumferentially spaced segments, and the threaded end is connected to a means for moving the mandrel along its longitudinal axis.

BEST MODE FOR CARRYING OUT THE INVENTION

Figure 1:
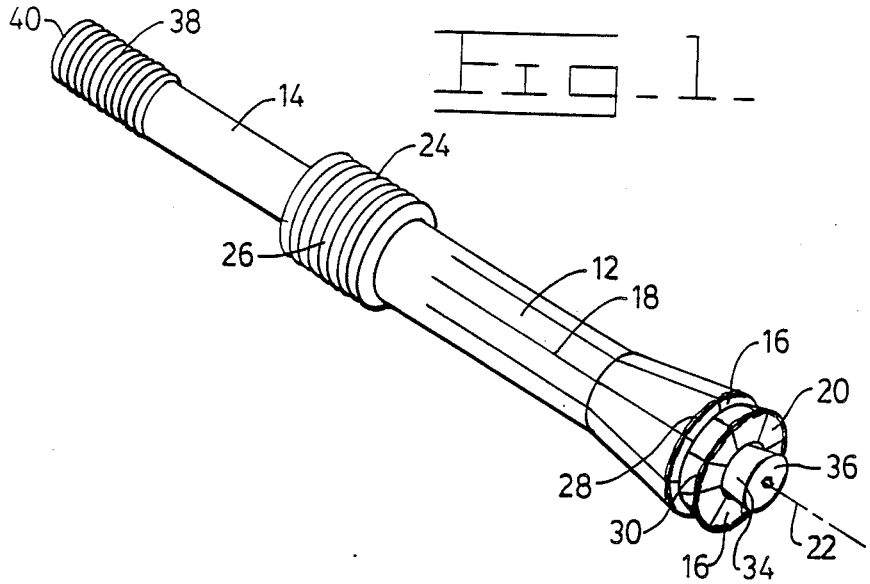
FIG. 1 is an isometric view of the punch and mandrel components of a tube expander according to the present invention.
Figure 2:
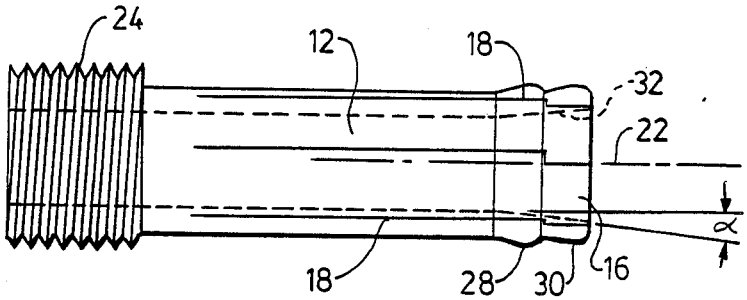
FIG. 2 is a plan view of the punch shown in FIG. 1.
Figure 3:
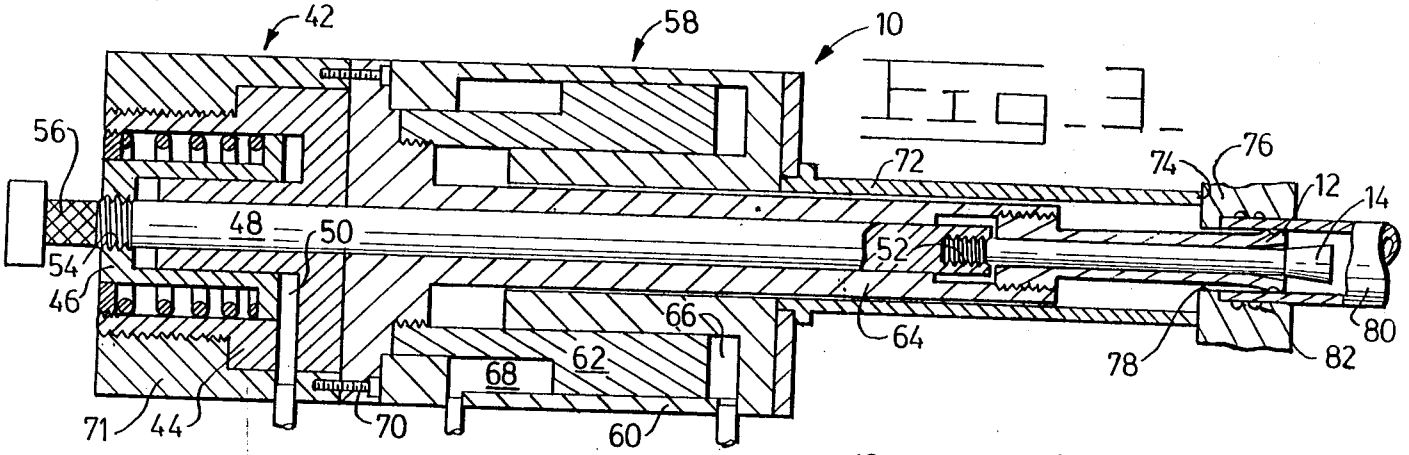
FIG. 3 is a sectional view of a tube expander according to the present invention, with the punch extended and positioned in a tube end prior to expansion and joining of the tube to a wall member.
Figure 4:
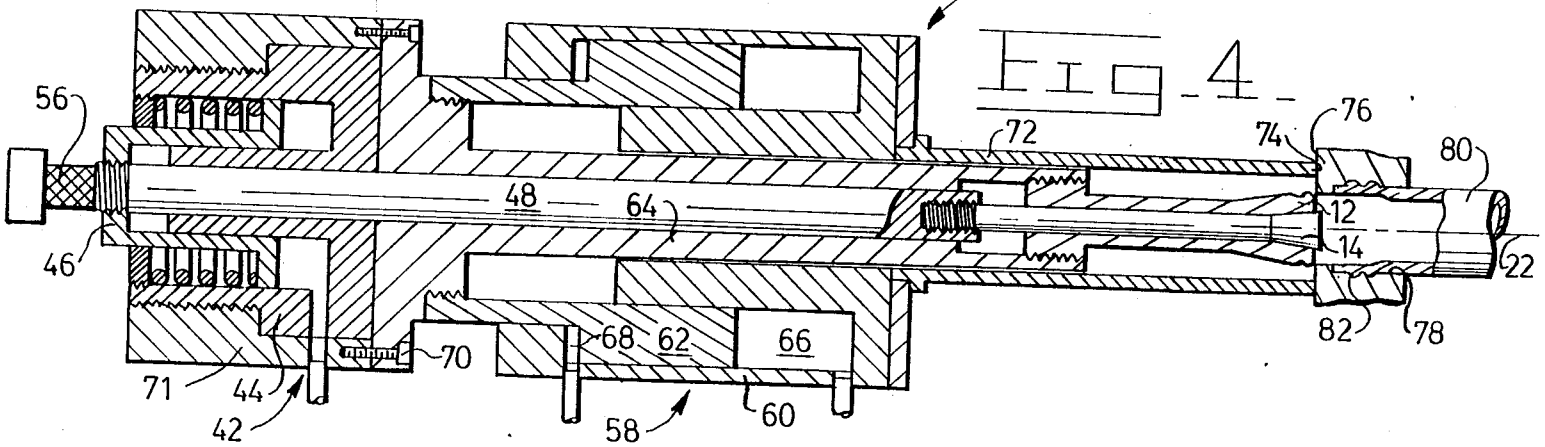
FIG. 4 is a sectional view of the tube expander shown in FIG. 3 with the punch shown in its retracted position after expansion of the tube and joining of the tube to the wall member.
Figure 5:
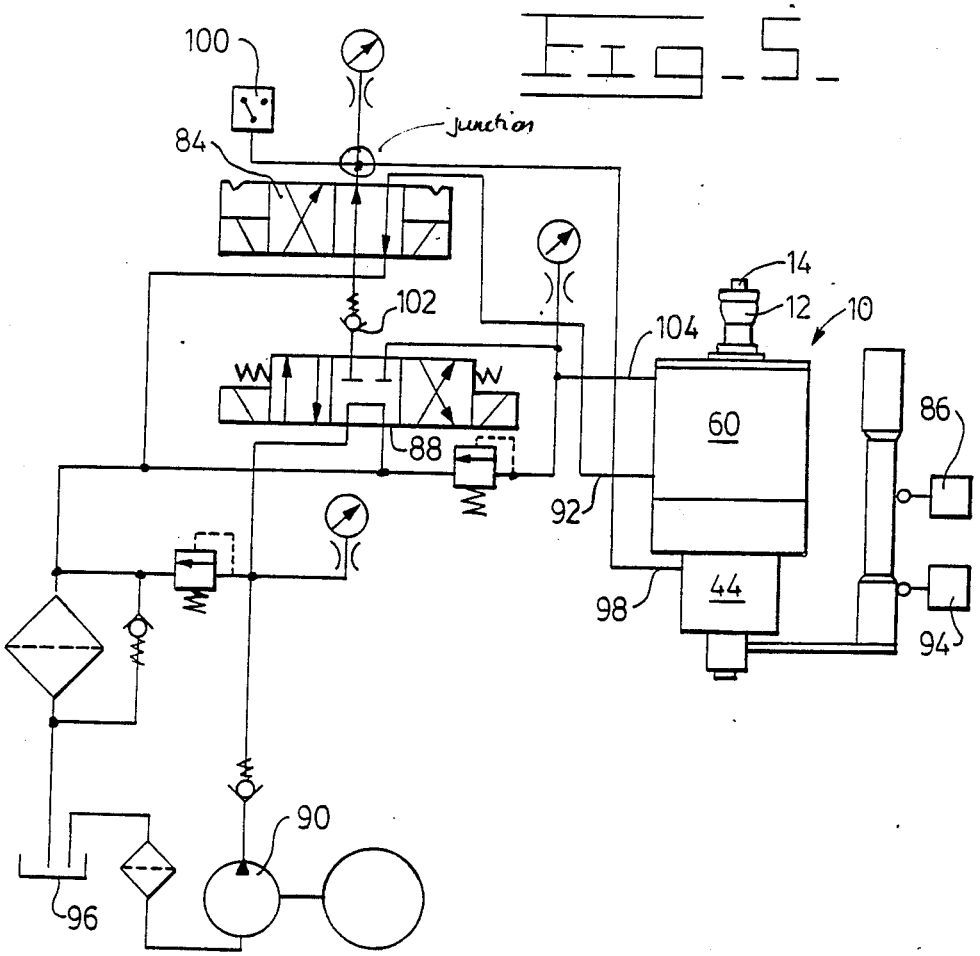
FIG. 5 is a schematic diagram of the hydraulic circuit for the tube expander.

An apparatus for expanding a tube, generally identified by the reference numeral 10 in FIGS. 3 through 5, includes an expandable annular elongate member or punch 12 positioned on a coaxially disposed solid mandrel 14. The punch 12 includes a plurality of radially movable or cantilevered, circumferentially spaced segments 16 which are separated by radial cuts, or slots, in an otherwise monolithic annularly-shaped tool. The radial slots 18 shown in FIGS. 1 and 2, extend from a distal end 20 of the punch 12 along a substantial length of the tool in a direction generally parallel with respect to the tool's longitudinal axis 22. A plurality of external threads 24 are formed on the opposite, or proximal, end 26 of the punch. The expandable punch is advantageously formed of a hardened tool steel and coated with a hard, wear resistant coating such as titanium nitride.

A pair of workpiece contact surfaces 28,30 are formed on a radially outer portion of each of the segments 16. The first workpiece contact surface 28 is longitudinally spaced and circumferentially offset with respect to the second workpiece contact surface 30. The circumferentially offset relationship of respective first and second workpiece contact surfaces on a segment is accomplished by circumferentially offsetting the longitudinal slots 18 defining the segments. The radial slots may be advantageously formed by electric discharge machining (EDM) or laser cutting thereby keeping the slots 18 as narrow as possible. A traveling wire EDM is particularly suitable for making the radial cuts. After making an initial longitudinal cut adjacent the second workpiece contact surface at the distal end of the punch, the punch is rotated about 10 degrees while continuing the cutting operation thereby forming a lateral, or circumferential, cut. After making the lateral cut, cutting along the longitudinal axis of the punch is resumed, forming the slot adjacent the first workpiece contact surfaces. The longitudinal slot is extended towards the proximal end of the punch to permit radial deflection of the segments 16.

Each of the workpiece contacting surfaces 28,30 on the segments 16 have a rounded shape, as seen in cross section, typical of punch-nose contours commonly used in metal extruding and cold working applications. Of particular advantage, the outer diameters of the workpiece contacting surfaces 28,30 are equal when the punch 12 is in its radially expanded position. An inner surface 32 of each of the segments 16 is tapered radially outwardly near the distal end 20 of the expandable punch. The angle of taper of the inner segment surfaces, represented by the letter $\alpha$ in FIG. 2, is advantageously about 5°.

The coaxially disposed solid mandrel 14 is also advantageously formed of a hardened tool steel. The punch has a frustoconical portion 34 at a distal end 36, and a threaded portion 38 formed on a proximal end 40. The frustoconical portion 34 has substantially the same angle of taper as the inner surfaces 32 of the segments 16, and mates with the inner surfaces during longitudinal movement of the mandrel with respect to the punch to move the segments in a radially outward direction.

A means 42 for moving the segments 16 outwardly in a radial direction includes the mandrel 14, a first hydraulic cylinder 44 having a hollow piston 46 centrally disposed therein, and a pull rod 48 connecting the mandrel 14 to the piston 46. As shown is FIGS. 3 and 4, the first hydraulic cylinder 44 is a single-acting spring return pull-action cylinder having a single internal pressure chamber 50. The pull rod 48 has internal threads 52 formed at a first end attached to the threaded portion 38 of the mandrel 14, and external threads 54 disposed intermediate the first end and a knurled handle 56 on the opposite end of the rod. The set position of the mandrel 14 with respect to the punch 12 may be adjusted by rotating the knurled handle 56 while holding the tube expander apparatus 10 stationary, thereby changing the relative engagement of the threaded portions of the pull rod 48 and the piston 46.

Leftward movement of the mandrel 14 relative to the expandable punch 12, as viewed in FIGS. 3 and 4, results in engagement of the frustoconical portion 34 of the mandrel 14 with the tapered inner surfaces 32 of the segments 16, thereby urging the segments radially outwardly. The amount of radially outward movement of the segments is determined by the longitudinal position of the mandrel with respect to the punch.

A means 58 for moving the punch 12 in a direction parallel with the longitudinal axis 22 of the punch includes a second hydraulic cylinder 60 having a centrally disposed hollow piston 62 and an adapter member 64 connecting the punch to the piston. The adapter member 64 has a plurality of internal threads at one end to receive the punch 12, and an externally threaded portion formed on the opposite end to receive an internally threaded end of the hollow piston 62. The second hydraulic cylinder 60 is advantageously a double acting cylinder having a pressure chamber 66,68 disposed on each side of the hollow piston. Pressurization of the chamber 66 moves the piston 62 leftwardly, as viewed in FIGS. 3 and 4; whereas, pressurization of the chamber 68 moves the piston, relative to the cylinder, in a direction to the right. The first hydraulic cylinder 44 is mounted on the adapter member 64 of the second hydraulic cylinder 60 by a plurality of screws 70 extending through the adapter member 64 and into a second adapter member 71 in which the body of the first cylinder 44 is threadably mounted. Movement of the piston 62, therefore, results in a corresponding movement of the first hydraulic cylinder 44.

A spacer member 72, having a predetermined length, is attached to the body end of the second hydraulic cylinder 60. A distal end 74 of the spacer member (i.e., the end opposite the attachment to the cylinder) is adapted to conform with the surface of a flange or wall member 76 having an opening 78 provided therein for receiving a tube 80. The length of the spacer member 72 determines the distance that the second hydraulic cylinder is spaced from the wall member and, consequently, the longitudinally extended position of the expandable punch 12 with respect to the prepositioned tube 80 in the opening 78.

The opening 78 may have a smooth bore, or more typically, have a plurality of radial grooves 82 formed therein. It is desirable to radially expand the tube by an amount sufficient to form a predetermined pressure contact between the outer surface of the tube and the opening. If the opening has a smooth bore, the integrity of the joint between the tube and the wall member is primarily determined by contact force between the members. In radially grooved openings, it is essential that the tube be expanded sufficiently to extrude a portion of the wall of the tube into the grooves of the wall member. It is therefore desirable to carefully control the amount of tube material extruded into the grooves to assure a strong mechanical joint without overfilling the grooves and overstressing the punch. Because of variations in the internal diameter and wall dimensions of commercially produced tube products, it has heretofore been difficult to consistently form a strong mechanical joint between such tubes and flanged fittings or walls. Punches having a predetermined diameter often fail to expand oversized tubes sufficiently to assure acceptable mechanical bonding, or break when attempting to expand undersized tubes.

Operation of the apparatus !0, and expansion of the tube into the wall opening, will be described with reference to the schematic hydraulic circuit shown in FIG. 5. A method of joining the tube 80 to a flanged fitting or to a wall member, such as the wall of a transmission case, includes as a first step, positioning the tube inside the opening 78 provided in the wall member 76. After positioning the tube end in the opening of the wall member 76, the apparatus 10 for expanding a tube is axially aligned with the opening, and the distal end 74 of the spacer member 72 is placed against the wall or flange surface. At this time, a two-position, four-way, solenoid-operated hydraulic valve 84 is shifted to the right and held in that position by the detent mechanism in the valve. Upon energizing an electrical circuit, not shown, a first limit switch 86 senses the retracted position of the punch 12 and signals a normally closed, three-position, four-way, solenoid-operated hydraulic valve 88 to shift to the right. Pressurized fluid from a motor-driven pump 90 is directed through the valves 84,88 to a conduit 92 communicating with chamber 68 in the second hydraulic cylinder, thereby moving the punch 12 and the mandrel 14 to an extended position within the prepositioned tube, as shown in FIG. 3. The chamber 50 in the first hydraulic cylinder is not pressurized, and the piston 46 is in its normal forward position. The frustoconical end 34 of the mandrel 14 is therefore extended in non-contacting relationship with the inner surface 32 of the segments 16.

A second limit switch 94 senses the extended position of the punch and mandrel and cancels the electrical current to the three-position valve 88. This permits the valve to return to its central position to direct the flow of pressurized fluid from the pump to a tank 96. At the same time, a signal is directed to the two-position valve 84 which shifts the valve to the left to place the cylinder chamber 68 in communication with the tank 96, thereby relieving pressure in the cylinder chamber.

After both valves have shifted, the three-position valve 88 is again shifted to the right and pressurized fluid is directed through the valves 84,88 to a conduit 98 communicating with the internal chamber 50 in the first hydraulic cylinder 44. Pressurization of the chamber 50 causes the hollow piston 46 to move away from the second hydraulic cylinder 60 and the mandrel 14 to move rearwardly, or leftwardly as viewed in FIGS. 3 and 4. This action brings the frustoconical portion 34 of the mandrel into pressure contact with the inner surfaces 32 of the segments 16 and moves the circumferentially spaced workpiece contacting surfaces 28,30 into contact with the internal surface of the tube.

An adjustable pressure switch 100, communicating with the conduit 98, senses the pressure in the circuit and, after reaching a predetermined pressure, sends an electrical signal to the three-position valve 88 shifting the valve leftwardly so that its most right hand chamber is in communication with the circuit. A check valve 102, in communication with the conduit 98 via the two-position valve 84, prevents the flow of fluid from the circuit communicating with the chamber 50, thereby maintaining the pressure in the chamber at the predetermined value.

The pressure at which the limit switch controls the above action is set at a value sufficient to assure that the outer surface of the tube 80 will be formed to a predetermined shape with respect to the surface defining the opening 78 in the wall member 76. The segments 16 are therefore expanded to a predetermined pressure contact with the tube, and not to a predetermined dimension or diameter. In an illustrative example, it has been found that a pressure of about 1200 psi (8274 kPa) is sufficient to expand a nominal 1 inch (2.5 cm) steel tube having a wall thickness of about 0.06 inch (1.5 mm) so that a 0.02 inch (0.5 mm) radial groove in the bore of the opening 78 is filled about 75% with material from the tube 80. Nominal variations in the internal or external diameters or thickness dimensions of the tube will not affect the pressure contact of the outer tube surface against the surface of the opening. In a grooved wall connection, the amount of tube material extruded into the grooves will be substantially the same irrespective of nominal variations in tube diameter and wall thickness, thereby assuring the uniformly consistent formation of strong mechanical joints. Furthermore, because the predetermined pressure is maintained in the circuit throughout the following step of longitudinally moving the punch, the desired controlled contact force of the outer surface of the tube on the internal surface of the wall opening is maintained substantially simultaneously with the longitudinal movement of the punch.

Upon shifting the three-position valve 88 leftwardly, as described above, in response to the pressure switch sensing the predetermined pressure, pressurized fluid from the pump 90 is directed through a conduit 104 communicating with the chamber 66 in the second hydraulic cylinder 60. Pressure in the chamber 66 moves the piston 62 leftwardly, as viewed in FIG. 4, thereby moving the punch and mandrel in a longitudinal direction toward the end of the opening opposite the initial forming position while simultaneously maintaining the controlled contact force on the inner surface of the tube 80.

During the longitudinal movement of the punch through the tube, the first workpiece contact surfaces 28 initially expand the tube according to the pressure maintained on the inner surface of the segments 16 by the position of the mandrel 14. However, since the segments are in a radially expanded position during the forming operation, a portion of the inner surface of the tube will be extruded into the longitudinal slots between the segments forming a plurality of inwardly extending ridges on the inner surface of the tube. However, these ridges are flattened, or ironed out, as a result of the subsequent inner surface contact by the circumferentially offset second workpiece contact surfaces 30, which trail the first contact surfaces. Since the second workpiece contact surfaces trail the first contact surfaces during the forming operation, the inwardly extending ridges are removed, and a smooth wall is resultantly formed on the inner surface of the tube.

After the punch 12 and mandrel 14 move to the outer end of the opening 78, the first limit switch 86 senses the completion of the forming operation and sends an electrical signal to the two-position valve 84 shifting the valve to the right and venting the chamber 50 in the first hydraulic cylinder to the tank 96. With pressure in the circuit relieved, the spring-biased piston 46 moves rightwardly, as viewed in FIGS. 3 and 4, thereby extending the mandrel 14. This action permits the segments 16 of the expandable punch 12, thus the workpiece contact surfaces 28,30 defined thereon, to move radially inwardly to a retracted position at which the workpiece contact surfaces are spaced from the inner surface of the tube 80.

After retraction of the workpiece contact surfaces, the tube expansion operation is complete, and the apparatus 10 for expanding a tube is moved away from the assembled tube and wall member.

INDUSTRIAL APPLICABILITY

The apparatus 10 for expanding a tube and the above-described method of joining a tube to a wall member are particularly useful for assembling tubes to preformed flanges for high pressure applications or to the walls of machine element housings, such as final drive or transmission cases, in lower pressure applications. The apparatus and method are suitable for joining a wide range of tube sizes, both in diameter and wall thickness, to such members.

The apparatus and method embodying the present invention also eliminate the work hardening and internal surface scaling or flaking problems common with conventional tube expansion techniques. Furthermore, the tool and method can be used in field applications with portable or manual hydraulic systems. Also, the offset segment cuts eliminate the multiple stroke operation required with the previously known and commonly used punch configurations.

Other aspects, objects and advantages of this invention can be obtained from a study of the drawings, the disclosure and the appended claims.

I claim:

1. A method of joining an outer surface of a tube to another member having an opening therethrough, including the steps of:

positioning one end of the tube into the opening in the member;

inserting an expandable tool having a first and second plurality of circumferentially spaced workpiece contacting surfaces into said one end of said tube;

moving said circumferentially spaced workpiece contacting surfaces radially outwardly into contact with an inner surface of said tube;

maintaining a controlled force on the moved workpiece contacting surfaces sufficient to conform said outer surface to the opening while longitudinally moving said expanded tool toward said one end of the tube and forming a plurality of radially inwardly extending ridges on the inner surface of the tube between the first plurality of workpiece contacting surfaces, said inwardly extending ridges being formed simultaneously with the conforming of the outer surface of the tube to said opening, subsequently contacting the inner surface of said tube with the second plurality of workpiece contacting surfaces to flatten the inwardly extending ridges and form a smooth wall on the inner surface of the tube;

moving said circumferentially spaced workpiece contacting surfaces radially inwardly; and withdrawing said tool from the one end of the tube.

2. An apparatus for expanding a tube having an inner surface, said apparatus comprising:

a punch having a plurality of circumferentially spaced segments, said segments having a radially inner surface and being movable in a radial direction with respect to a longitudinal axis of said punch;

a first workpiece contacting surface disposed on a radially outer portion of each of said segments of the punch;

a second workpiece contacting surface disposed on a radially outer portion of each of said segments of the punch, said second workpiece contacting surface being circumferentially offset and longitudinally spaced with respect to said first workpiece contacting surface;

first means for moving said segments outwardly in said radial direction, said means having a mandrel, said mandrel being coaxially disposed with respect to the longitudinal axis of said punch and having a frustoconical portion at a distal end and a connecting portion at a proximal end of said mandrel, said frustoconical portion being positioned radially inwardly of said radial inner surface of the segments, and second means for moving the mandrel along said longitudinal axis, said second means being connected to said connecting portion of the mandrel;

third means for moving said punch and said first means simultaneously in a direction parallel with the longitudinal axis of said punch; and fourth means for controlling the first and third means; said third means maintaining a variable pressure on said first means to cause said first means to maintain a substantially constant force of the first and second workpiece contact surfaces against the inner surface of the tube being expanded in the opening.

3. An apparatus for expanding a tube as set forth in claim 2 wherein the second means is a first hydraulic cylinder, said cylinder has a piston connected to a pull rod extending from the piston to said mandrel.

4. An apparatus for expanding a tube as set forth in claim 3 wherein the third means includes a second hydraulic cylinder which includes a centrally disposed hollow piston, said first hydraulic cylinder is mounted on the hollow piston of said second cylinder, the hollow piston includes an adapter member extending between the hollow piston and the punch, said first hydraulic cylinder and the punch are simultaneously moved with the hollow piston of the second cylinder.

5. An apparatus for expanding a tube as set forth in claim 4, wherein the fourth means includes a control for directing hydraulic fluid to said first and second hydraulic cylinders, said control has a plurality of pressure valves to adjust the pressure to the first cylinder to maintain a constant force between the workpiece contact surfaces and the inner wall of the tube as the punch is pulled through the tube.

6. A tube expander comprising:

an elongate member having a longitudinal axis and a plurality of circumferentially spaced segments at its distal end, each segment having an inner surface and being cantilevered from a point spaced longitudinally from said distal end, the distal end of each segment being movable in a radial direction with respect to the longitudinal axis from a first at-rest position outwardly to a second position, each segment having first and second arcuate outer surfaces at the distal end for contacting the inside of a tube, the arcuate surfaces being longitudinally spaced and circumferentially offset with respect to each other, each segment having longitudinal radially-extending sides each of which is parallel to the side of the adjacent segment in the at-rest position, and the sides being closely adjacent each other;

a mandrel coaxial with the longitudinal axis, the mandrel having a frustoconical portion at its distal end for contacting said inner surfaces of the segments; and means for moving the mandrel along said longitudinal axis toward the distal end of the segments to move them outwardly in said radial direction from the first at-rest position to the second position, said means being movable away from the distal end of the segments to allow them to return to the at-rest position.

7. A method of joining a tube to a bore surface defining an opening, including the steps of:

positioning an end of said tube into one end of the opening;

inserting an expandable punch having a plurality of circumferentially spaced workpiece contacting surfaces into the end of said tube positioned in said opening, from an end of the opening opposite said one end;

moving said circumferentially spaced workpiece contacting surfaces radially outwardly and contacting an inner surface of said tube with a controlled force sufficient to form an outer surface of the tube to a predetermined shape with respect to a surface defining the opening;

longitudinally moving said punch toward said opposite end of the opening initially contacting the inner surface of said tube with a first plurality of circumferentially spaced workpiece contacting surfaces on said punch and forming a plurality of radially inwardly extending ridges on the inner surface of the tube between adjacent workpiece contacting surfaces, said inwardly extending ridges being formed simultaneously with the forming of the outer surface of the tube to said predetermined shape, subsequently contacting the inner surface of said tube with a second plurality of workpiece contacting surfaces on said punch to flatten the inwardly extending ridges and form a smooth wall on the inner surface of said tube, and simultaneously maintaining a substantially constant contact force on the inner surface of said tube;

moving said circumferentially spaced workpiece contacting surfaces radially inwardly; and, withdrawing said expandable punch from the opening in said wall member.

* * * * *